US005730044A

United States Patent [19]

Oh

[11] Patent Number: 5,730,044

[45] Date of Patent: Mar. 24, 1998

[54] METHOD AND APPARATUS FOR ATTACHING A PISTON TO A CONNECTING ROD IN A COMPRESSOR

[75] Inventor: Il Kyo Oh, Seoul, Rep. of Korea

[73] Assignee: Samsung Electronics Co., Ltd., Suwon, Rep. of Korea

[21] Appl. No.: 731,311

[22] Filed: Oct. 15, 1996

[30] Foreign Application Priority Data

Nov. 9, 1995 [KR] Rep. of Korea ..... 95-40465

[51] Int. Cl.[6] ..... F01B 29/00

[52] U.S. Cl. ..... 92/128; 92/187; 74/579 E

[58] Field of Search ..... 92/128, 187, 188, 92/190, 191, 216, 221; 74/579 E

[56] References Cited

U.S. PATENT DOCUMENTS

| | | | |
|---|---|---|---|
| 1,435,528 | 5/1922 | Keilholtz | 92/187 |
| 1,554,157 | 9/1925 | Deans | 92/187 |
| 1,578,315 | 3/1926 | Heslewood | 92/187 |
| 1,709,316 | 4/1929 | Lord | 92/188 |
| 1,810,423 | 6/1931 | Hatch . | |
| 1,838,216 | 12/1931 | Dickey | 92/187 |
| 4,406,590 | 9/1983 | Kesler | 92/128 |
| 5,499,571 | 3/1996 | Dreiman | 92/128 |

*Primary Examiner*—Thomas E. Denion

*Attorney, Agent, or Firm*—Burns, Doane, Swecker & Mathis, L.L.P.

[57] ABSTRACT

A piston of a compressor is connected to a motor-driven connecting rod by a piston pin which is inserted into an aperture of the piston and into an opening of the connecting rod which is aligned with the aperture. A first support pin disposed in the piston extends across the aperture to limit the insertion of the piston pin. Then, a second support pin disposed in the piston is pushed manually across the aperture, whereby the piston pin is trapped between the two support pins and cannot be dislodged during operation of the compressor.

8 Claims, 7 Drawing Sheets

METHOD AND APPARATUS FOR ATTACHING A PISTON TO A CONNECTING ROD IN A COMPRESSOR

FIELD OF THE INVENTION

The present invention relates to a reciprocating compressor. More particularly, it relates to a reciprocating compressor capable of improving the operation efficiency of assembling a piston and a connecting rod in a cylinder.

BACKGROUND OF THE INVENTION

Generally, as shown in FIG. 6 a conventional reciprocating compressor compresses refrigerant gas or air to a high temperature and high pressure and then discharges the compressed gas or air outwardly. Such a reciprocating compressor is comprised of a driving unit 20 for generating a rotation power within a hermetically sealed outer housing 10 comprising upper and lower halves 11 and 12, and a compressor 30 for causing the rotation power received from the driving unit 20 to draw and compress the refrigerant, and then discharge it outwardly.

The driving unit 20 includes a stator 21, a rotor 22, a crankshaft 23 which is inserted into the rotor 21 and is rotated, and an eccentric shaft 24 which is integrally formed with the crankshaft 23. Further, the driving unit 20 is provided with a bearing 25 for supporting the rotor 22 and the crankshaft 23 so that they can be rotated between the upper surface of the bearing 25 and the rotor 22, a washer 26 is located.

The compressor 30 is comprised of a cylinder 31 for forming a space where the refrigerant is drawn and compressed, a piston 32 for reciprocating within the interior of the cylinder 31, and a connecting rod 33 for connecting the eccentric shaft 24 and the piston 32 for converting the rotation movement of the crankshaft 23 into the reciprocating movement of the piston 32.

To assemble the crankshaft 23, the piston 32, and the connecting rod 33, it is necessary that the bearing 25 and the cylinder 31 can be separated from each other, or another method is to drive a washer into the bearing 25 or the connecting rod 33. However, there are difficulties in the maintenance of precision tolerance, since the above structure requires the assembling of two or more parts.

An apparatus to solve these problems is disclosed in U.S. Pat. No. 4,406,590. FIG. 7 shows such an apparatus wherein a bearing 25 and cylinder 31 are formed integrally and a slot 40 is formed in the sidewall of cylinder 31, the connecting rod 33 being joined to the piston 32 through this slot 40.

A detailed assembling method for the components of FIG. 7 will now be explained below. First, connecting rod 33 is inserted into the interior of the cylinder 31 through its slot 40 and at the same time, the eccentric shaft 24 is inserted into the big opening 34 of connecting rod 33. Then, piston 32 is inserted through the opening at the side of cylinder 31 so that the small opening 35 of connecting rod 33 can be inserted into interior space 41 which is formed in a horizontal direction of piston 32. When the small opening 35 is aligned with a pair of aligned openings 42 and 43 formed through the upper and lower walls of piston 32 a piston pin 50 is inserted through the slot 40 of cylinder 31, and into the lower opening 42 of piston 32, the small opening 35 of connecting rod 33, and the upper opening 43 of piston 32. A groove 51 formed along the lower periphery of piston pin 50 is not inserted into the small opening 35 of connecting rod 33, but is located in the interior space 41 of piston 32. To prevent the piston pin 50 from becoming dislodged during movement of piston 32, a generally U-shaped spring clip 52 is slipped within the groove 51 from the left side. After assembling the piston 32 and connecting rod 33 using the piston pin 50 as mentioned above, counterweight 53 and lubricant distribution tube 54 are connected to the eccentric shaft 24 by means of a screw.

In assembling the connecting rod 33 and piston 32 using the piston pin 50, when the spring clip 52 is coupled to the groove 51 of piston pin 50, however, there is no way of defining the insertion depth of piston pin 50 within the small opening 35. Thus, if the insertion depth of piston pin 50 is more or less than a preset insertion depth required for properly locating the groove 51 within the interior space 41 of the piston 32 it is difficult to couple the spring clip 52 to the groove 51 correctly. Especially, the coupling of spring clip 52 must be made in a narrow space between connecting rod 33 and an inner surface of interior space 41 making the coupling even more difficult and complicated.

SUMMARY OF THE INVENTION

It is an object of the present invention to provide a reciprocating compressor capable of improving the operation efficiency of a piston pin assembly by defining the insertion depth of the piston pin when connecting a piston and a connecting rod by pushing the piston pin through a slot formed in the sidewall of the cylinder.

In order to achieve the above objectives and advantages, a reciprocating compressor in accordance with the present invention comprises a housing having a cylinder therein, a piston executing a rectilinear motion, a crankshaft executing a rotational motion, a connecting rod disposed between the piston and the crankshaft for transferring the crankshaft motion to the piston motion, and a piston pin for connectinng one end of the connecting rod to the piston, and further comprises a first supporting means for limiting the forward motion of the piston, and second supporting means for preventing the piston pin from getting out of the piston.

A portion making contact with the first supporting means is formed in the front end of the piston pin, and a portion contacting the second supporting means is formed in a back end of the piston pin opposite to the front end.

BRIEF DESCRIPTION OF THE DRAWINGS

Reference will now be made to the following drawings in which.

DESCRIPTION OF THE PREFERRED EMBODIMENT

A preferred embodiment of the present invention will now be discussed in detail with reference to the accompanying drawings.

Figure 1:
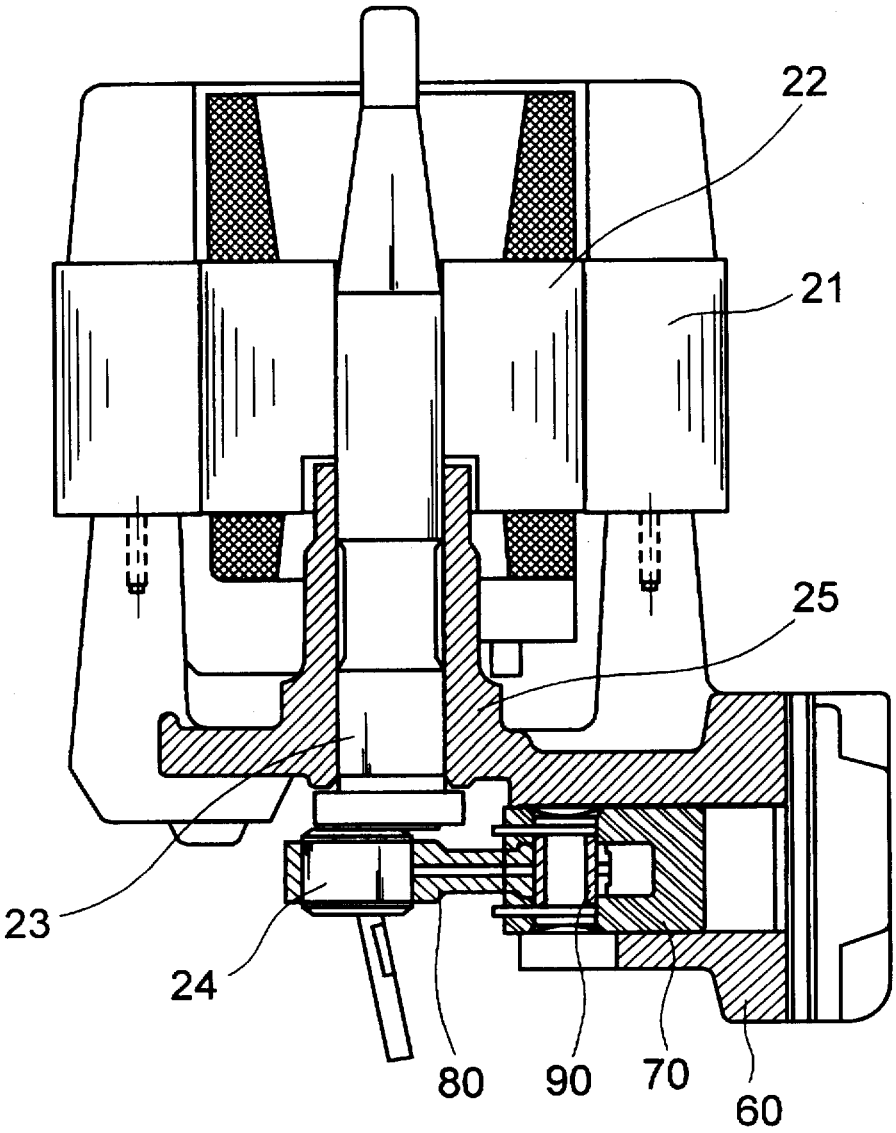
FIG. 1 is a sectional view showing the state of how piston and connecting rod are assembled to a cylinder in accordance with the assembling method of the present invention.

FIG. 1 shows a reciprocating compressor in accordance with the present invention. As the prior art, the compressor of the present invention has a bearing 25 for rotatably supporting a crankshaft 23 and a cylinder 60 providing a space for compressing gas. The left end of connecting rod 80 is coupled to an eccentric shaft 24, and its right end is coupled to a piston 70 by means of a piston pin 90. In the reciprocating compressor as designed above, the present invention is to improve the assembling method of the connecting rod 80 and the piston 70.

Figure 2:
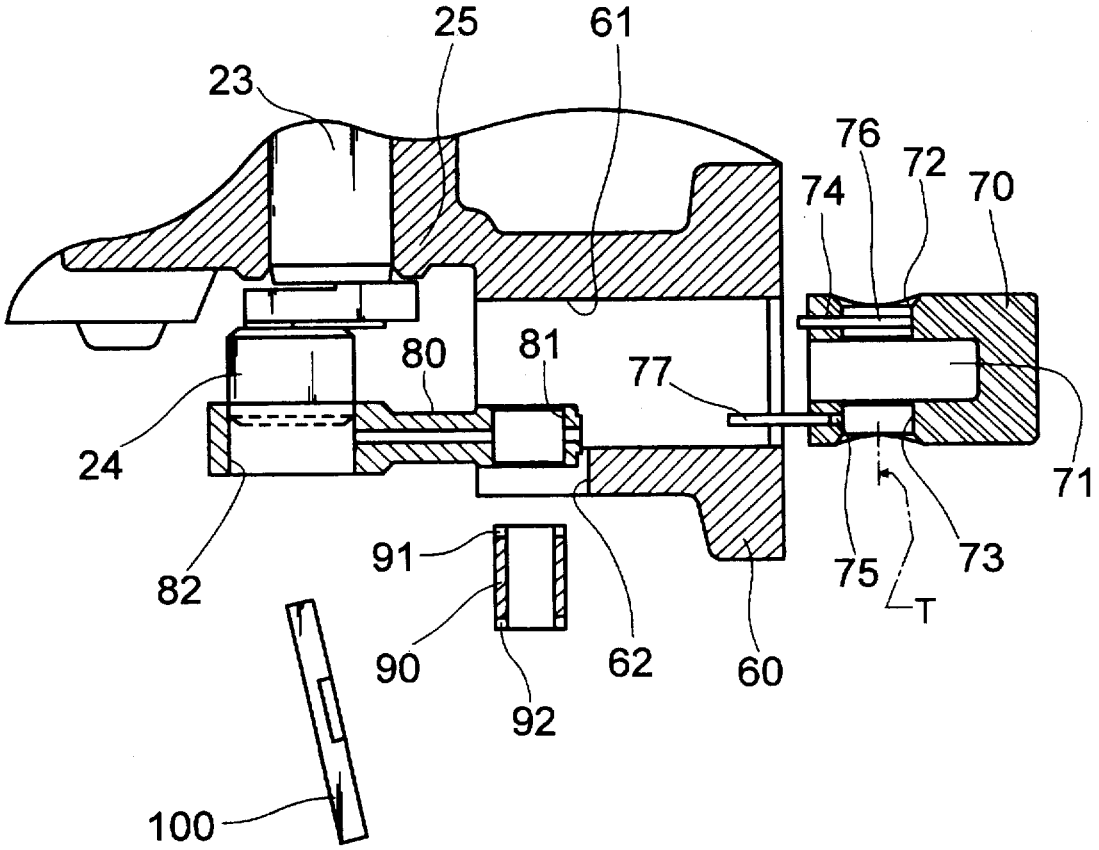
FIGS. 2 to 4 are views showing a series of sequences in which the piston and the connecting rod are assembled to the cylinder by means of a piston pin in accordance with the present invention.
Figure 3:
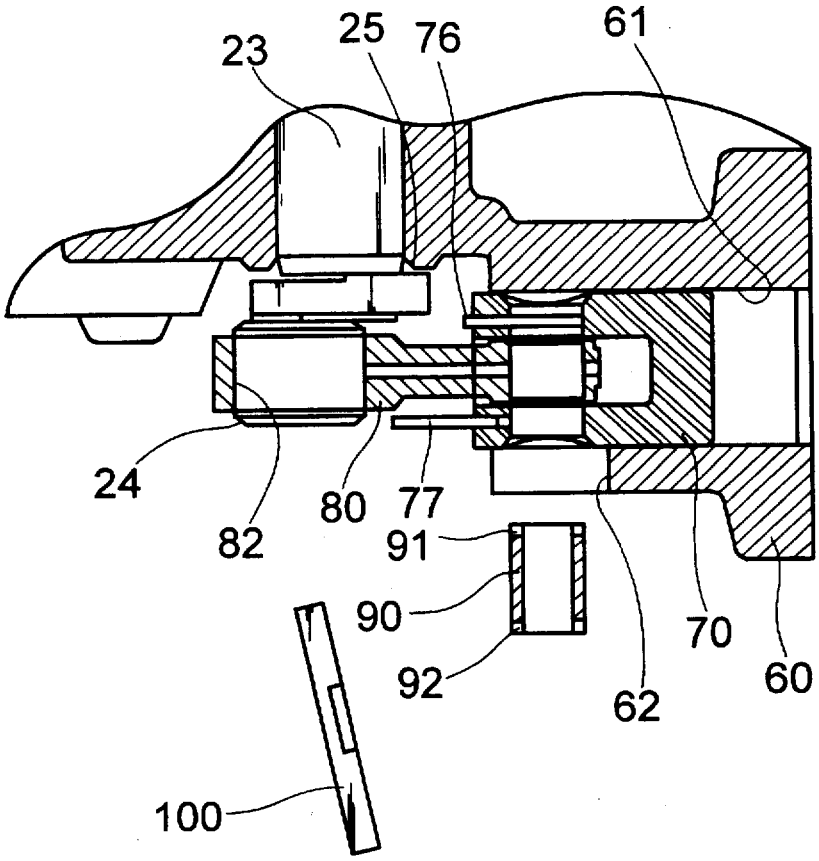
Figure 4:
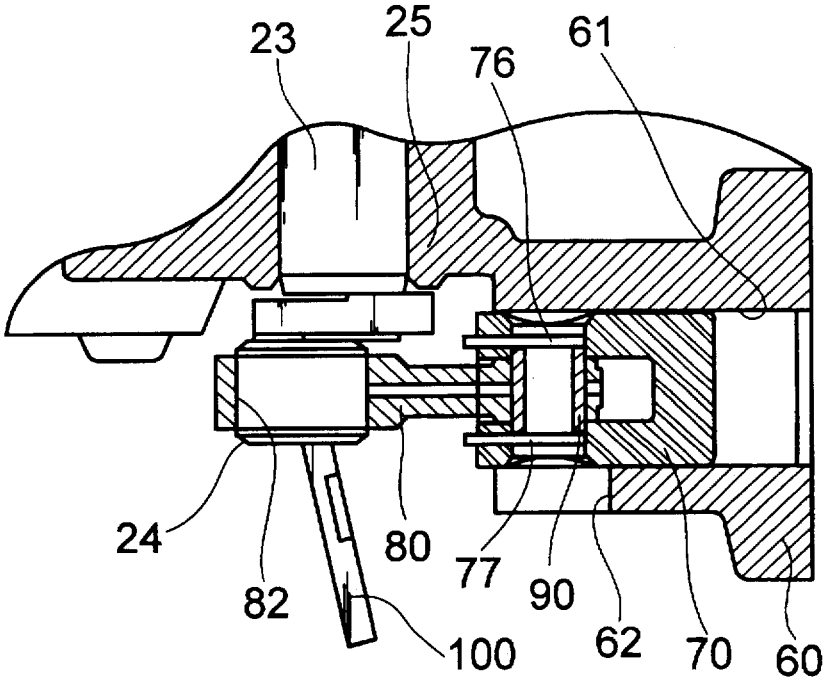

FIGS. 2 to 4 show a structure of the piston 70, the connecting rod 80, and the piston pin 90, and a series of sequences for assembling them.

As shown in FIG. 2, the cylinder 60 has an interior through-hole or bore 61, and a slot 62 is formed in its bottom.

The piston 70 includes an interior space 71 extending from the center of its left end by a given length along a horizontal line, and an aperture defining a transverse axis T extending transversely relative to a longitudinal axis of the piston. The aperture includes first end segments 72, 73 disposed on opposite sides of the interior space 71, respectively. First and second locking pin holes 74, 75 are formed in the piston on opposite sides of the space 71. The holes 74, 75 extend parallel to the longitudinal axis of the piston and communicate with respective ones of the aperture segments 72 and 73. First and second locking pins 76, 77 can be press fit into the holes 74, 75, respectively until they extend across respective ones of the aperture segments and abut side walls of those respective aperture segments.

The connecting rod 80 has a small opening 81 at one end thereof for accommodating the piston pin 90, and a big opening 82 coupling to the eccentric shaft 24 at the other end thereof.

Figure 5:
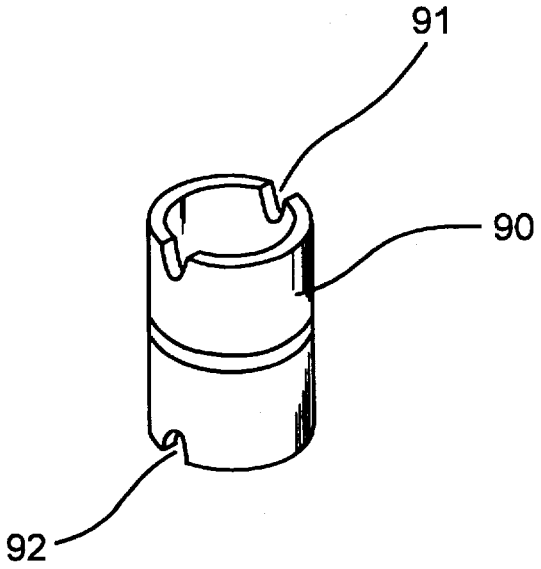
FIG. 5 is a perspective view showing the structure of the piston pin of the present invention.
Figure 6:
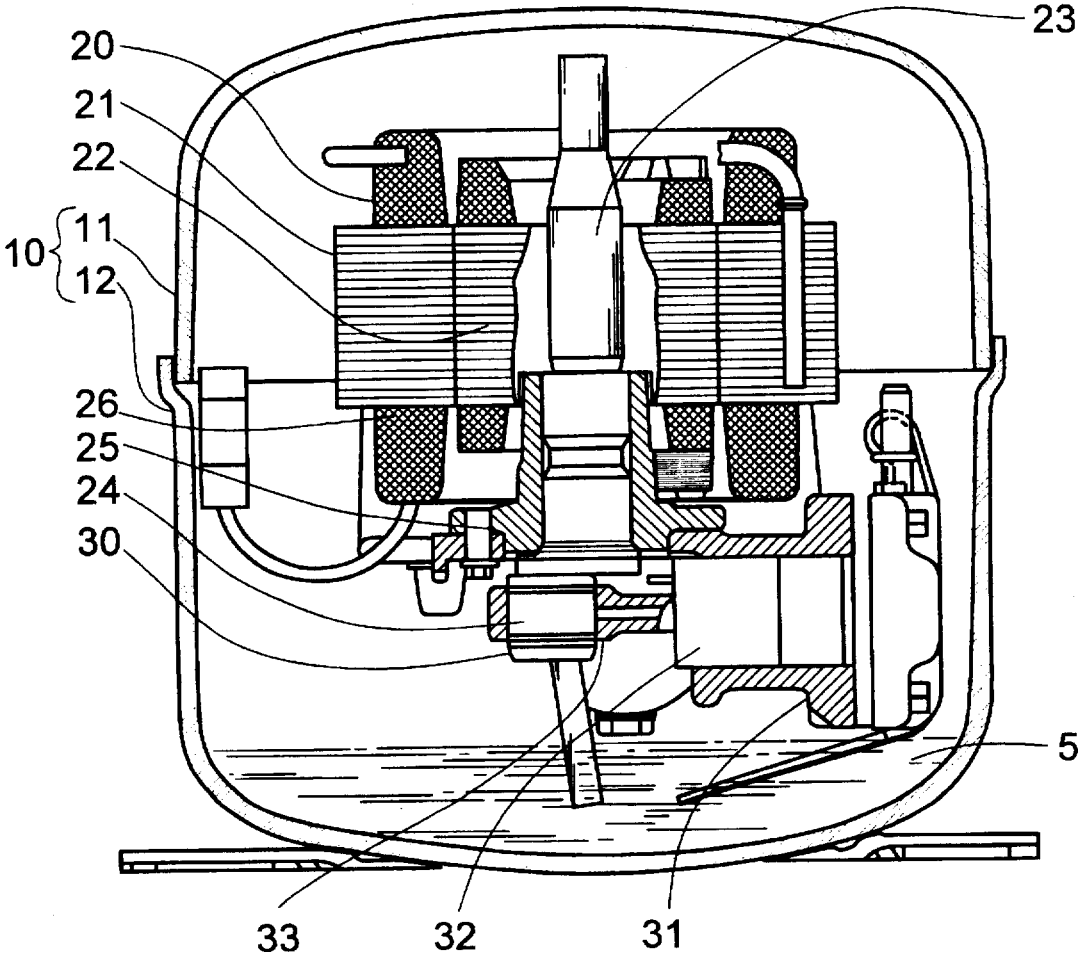
FIG. 6 (PRIOR ART)
FIG. 6 is a sectional view showing the interior of the prior art reciprocating compressor.
Figure 7:
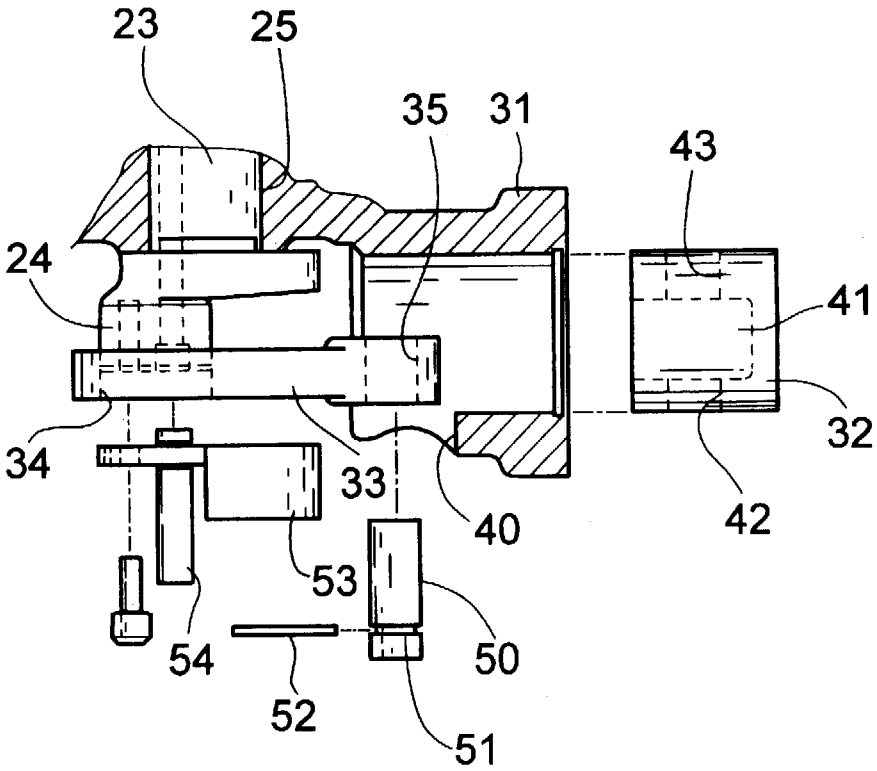
FIG. 7 (PRIOR ART)
FIG. 7 is a fragmentary, exploded view of the piston, the connecting rod, and the cylinder of FIG. 6.

The piston pin 90 has a hollow cylindric shape wherein first and second recceses in the form of slits 91 and 92 are formed in upper and lower ends, respectively, of the pin 90 in left and right symmetry. Since the pin 90 is hollow, each of the slits 91, 92 includes diametrically opposed segments (see FIGS. 5). The slits 91 and 92 are formed of a shape having a width with narrows in a direction toward the center of piston pin 90, as shown in FIG. 5. The slits 91 and 92 intersect a cylindrical outer surface of the piston pin.

Reference numeral 100 represents an oil pickup for providing a contacting surface between the crankshaft 23 and bearing 25 with a lubricant.

Detailed assembling method of the reciprocating compressor according to the present invention will now be explained below. As shown in FIG. 2, connecting rod 80 is inserted into the interior hole 61 of cylinder 60 through its slot 62 and at the same time, the eccentric shaft 24 is coupled to the big opening 82 of connecting rod 80.

Then, piston 70 is inserted into the interior hole 61 from the right side of cylinder 60 so that the right end of connecting rod 80 enters the interior space 71 of piston 70 as shown in FIG. 3. In this case, the small opening 81 of connecting rod 80 is aligned with the first and second openings 72 and 73 of piston 70. At this time, the first locking pin 76 is press inserted through the first locking pin hole 74 and located to the right side surface of first opening 72, and the second locking pin 77 is hanging about the left side of second locking pin hole 75.

In this state, if the piston pin 90 is inserted through the slot 62 of cylinder 60, and successively into the second opening 73 of piston 70, the small opening 81 of connecting rod 80, and the first opening 72 of piston 70 then, the first slit 91 of piston pin 90 receives the first locking pin 76, so that the correct insertion depth of the piston pin 90 within the piston 70 is determined. In this state, the second locking pin 77 in press fit in the right hand direction, whereby the second locking pin 77 extends through the second slit 92 of piston pin 90 of piston 70 as shown in FIG. 4, so that the assembly of piston 70 and connecting rod 80 is completed. Then, the oil pickup 100 is fixed to the eccentric shaft 24.

As described above, according to the assembling structure of the present invention, the insertion depth of piston pin 90 is correctly determined by the first locking pin 76, thereby improving the operation efficiency of assembly. Further, since the piston pin 90 has symmetry different from the prior art, assembly is easier.

What is claimed is:

1. A reciprocating compressor, comprising:

a housing;

a cylinder disposed in the housing and defining a bore into which gas is to be introduced, the bore defining a longitudinal axis;

a piston reciprocably mounted in the bore for compressing gas therein, the piston including an aperture extending transversely of the longitudinal axis and defining a transverse axis, the piston including a pair of holes intersecting the aperture;

a driven crankshaft disposed in the housing;

a connecting rod interconnecting the piston and crankshaft for reciprocating the piston in response to rotation of the crankshaft, the connecting rod including an opening aligned with the aperture along the transverse axis;

a piston pin disposed in the opening and aperture, the piston pin comprising a cylindrical outer surface and first and second end faces at respective opposite ends of the piston pin, the first and second end faces including first and second recesses, respectively, intersecting the cylindrical outer surface and aligned with respective ones of the holes; and first and second supports mounted in respective ones of the holes and extending across the aperture in a direction transversely of the transverse axis, the first and second supports being received in the first and second recesses, respectively, on opposite sides of the opening for limiting movement of the piston pin in first and second directions, respectively, along the transverse axis for preventing the piston pin from leaving the aperture and the opening during operation of the compressor.

2. The reciprocating compressor according to claim 1 wherein the first and second supports comprise first and second pins oriented parallel to the longitudinal axis.

3. The reciprocating compressor according to claim 2 wherein the pins are of rectangular cross section.

4. The reciprocating compressor according to claim 1 wherein the piston pin comprises a hollow rod.

5. The reciprocating compressor according to claim 1 wherein the piston pin comprises a hollow rod, the first recess comprising diametrically opposed recess segments formed in one end of the rod and the second recess comprising diametrically opposed recess segments formed in the other end of the rod, each pin received in both of the recess segments of the respective recess.

6. The reciprocating compressor according to claim 5 wherein each of the recess segments is of narrowing width in a direction away from its respective end face.

7. The reciprocating compressor according to claim 1 wherein the holes extend parallel to the longitudinal axis and are aligned with the first and second recesses, respectively.

8. A method of coupling a connecting rod to a piston of a reciprocating compressor, comprising the steps of:

A) inserting one end of the connecting rod into an interior space of the piston such that an opening in the connecting rod is aligned with a transverse aperture formed in the piston, the aperture extending transversely relative to a longitudinal axis of the piston;

B) mounting a first support in a first hole in the piston such that the first support extends across the aperture in a direction transversely of an axis of the aperture; thereafter C) inserting a piston rod into the mutually aligned opening and aperture until a first end face of the piston rod abuts the first support such that the first support is received in a first recess formed in the first end face in intersecting relationship to a cylindrical outer surface of the piston; and thereafter D) mounting a second support through a second hole in the piston such that the second support extends across the aperture adjacent a second end face of the piston pin, with the second support received in a second recess formed in the second end face in intersecting relationship to the cylindrical outer surface, thereby preventing movement of the piston pin out of the opening and aperture during operation of the compressor.

* * * * *